US006615996B1

(12) United States Patent
Ivey

(10) Patent No.: US 6,615,996 B1
(45) Date of Patent: Sep. 9, 2003

(54) CARRYING CASE AND RACK FOR WINE BOTTLES

(76) Inventor: Jason A. Ivey, 356 Coronado #306, Long Beach, CA (US) 90814

( * ) Notice: Subject to any disclaimer, the term of this patent is extended or adjusted under 35 U.S.C. 154(b) by 0 days.

(21) Appl. No.: 10/171,672

(22) Filed: Jun. 17, 2002

(51) Int. Cl.[7] ..... A47B 73/00

(52) U.S. Cl. ..... 211/74; 217/19; 206/175; 211/72; 211/189

(58) Field of Search ..... 211/71.01, 74, 211/72, 73, 189, 184, 195, 175; D7/704; 206/175, 178, 180, 427, 45.25, 45.27, 45.29, 45.3, 176, 193, 362.4, 395, 784, 750, 525.1; 217/19, 21; 220/507, 509, 512, 510, 515, 528, 529, 532, 4.28, 4.01, 6

(56) References Cited

U.S. PATENT DOCUMENTS

| | | | | | |
|---|---|---|---|---|---|
| 1,011,857 | A | * | 12/1911 | Scherer | 211/72 |
| 1,079,158 | A | * | 11/1913 | Beatty | 248/450 |
| 1,968,880 | A | * | 8/1934 | Ebert | 211/72 |
| 2,102,982 | A | * | 12/1937 | Taylor | 211/1.53 |
| 2,145,879 | A | * | 2/1939 | Jewett | 211/72 |
| 2,289,859 | A | * | 7/1942 | Arthur | 206/175 |
| 2,307,992 | A | * | 1/1943 | Calhoun et al. | 206/733 |
| 2,340,230 | A | * | 1/1944 | Slevin, Jr. | 206/171 |
| 2,345,565 | A | * | 4/1944 | Arneson | 206/175 |
| 2,837,216 | A | | 6/1958 | Paige | 211/72 |
| 2,840,293 | A | | 6/1958 | Paige | 229/15 |
| 3,572,534 | A | * | 3/1971 | Benoit | 217/19 |
| 3,958,745 | A | * | 5/1976 | Lindsay | 229/120.26 |
| 4,396,116 | A | * | 8/1983 | Stone | 206/162 |
| 4,530,548 | A | * | 7/1985 | Spamer et al. | 312/45 |
| 5,484,053 | A | * | 1/1996 | Harris | 206/147 |
| 5,950,831 | A | * | 9/1999 | Millet | 206/446 |
| 5,960,981 | A | * | 10/1999 | Dodson et al. | 220/563 |
| 6,105,796 | A | * | 8/2000 | Buchanan et al. | 211/128.1 |
| 6,474,473 | B2 | * | 11/2002 | Wong | 206/590 |

FOREIGN PATENT DOCUMENTS

| | | | | |
|---|---|---|---|---|
| NL | NE104284 | * | 5/1963 | 211/74 |

* cited by examiner

*Primary Examiner*—Daniel P. Stodola
*Assistant Examiner*—Jennifer E. Novosad
(74) *Attorney, Agent, or Firm*—Edgar W. Avarill, Jr.

(57) ABSTRACT

A carrying case for carrying and displaying consumer products, such as wine bottles. The carrying case can be restructured into a wine rack. The carrying case has a front and a back wall panel, each having an opening through which a portion of a wine bottle, or other consumer product, may extend. Two side panels connect to the front and back panels to secure the wine bottles by way of extending partially through the front and back wall panels. A central slot permits the four pieces to be reassembled into a wine rack which can hold wine bottles in a horizontal position.

10 Claims, 3 Drawing Sheets

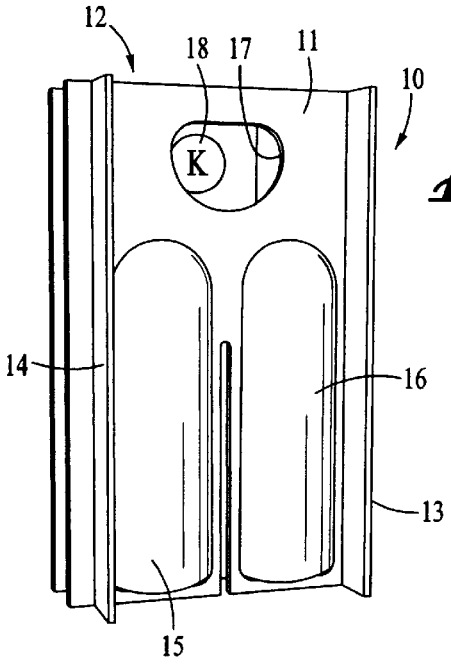
FIG. 1
FIG. 3
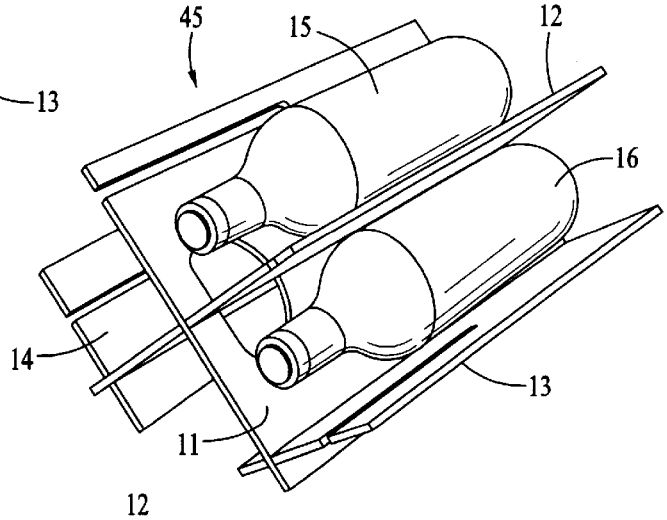
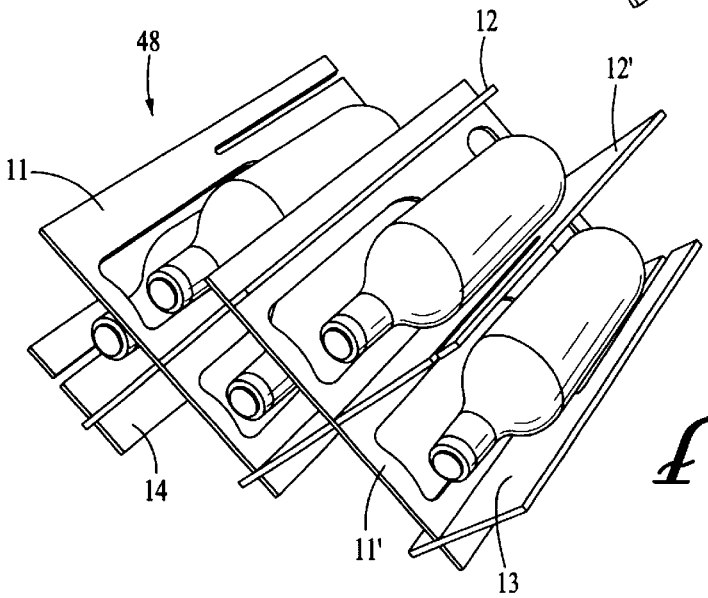
FIG. 4

CARRYING CASE AND RACK FOR WINE BOTTLES

BACKGROUND OF THE INVENTION

The field of the invention is packaging and the invention relates more particularly to packaging for consumer products which provide an attractive display when placed on the shelf of a retail outlet.

Shipping containers utilizing slots cut from a bottom edge or a top edge half way through a panel of the box are well known. U.S. Pat. No. 2,840,293 shows a shipping case having inner panels with slots which form rectangular openings to protect bottles during shipping. Similarly, U.S. Pat No. 2,837,216 shows a display stand and shipping container which also utilizes panels with slots cut part way through them.

For some products, the appearance of the product is enhanced by the ability of the consumer to view the product utilizing the product's transparency by looking at one side and being capable of seeing through the back side while the product is in the container. Wine is especially benefited from such display, since the color of the wine is often very appealing and helps to display the wine in a much more attractive and appealing manner, particularly as compared to a wine bottle on a shelf, which has an opaque back.

BRIEF SUMMARY OF THE INVENTION

The present invention is for a carrying and display case for carrying and displaying consumer products, such as bottles of wine, which permit the carried product to be viewed from the front to the back while still in the container.

It is another object of the present invention to provide a carrying case for wine bottles which may be reassembled into a wine rack.

The present invention is for a carrying case for carrying and displaying one or more consumer products. The front and back wall panels have an at least one consumer product opening shaped to secure the consumer product between the front and back wall panels when the wall panels are held together by right and left side panels. Right and left side panels have a pair of slots which mate with the slots in the front and back wall panels to form a rectangular carrying case with matched consumer product openings. When the carrying case is used for wine, a preferred configuration utilizes two openings in each of the front and back panels so that two bottles of wine may be carried. Alternatively, the carrying case can hold one bottle of wine and two wine glasses, or one wine glass and a third item, such as a corkscrew.

BRIEF DESCRIPTION OF THE DRAWINGS

FIG.1 is a perspective view of a carrying case of the present invention holding two bottles of wine.

FIG. 3 is a perspective view of the panels of the wine case of FIG. 1, reoriented into the configuration of a wine rack.

FIG. 4 is a perspective view of a larger wine rack made with two of the carrying cases of FIG. 1.

DESCRIPTION OF THE PREFERRED EMBODIMENTS

Figure 2:
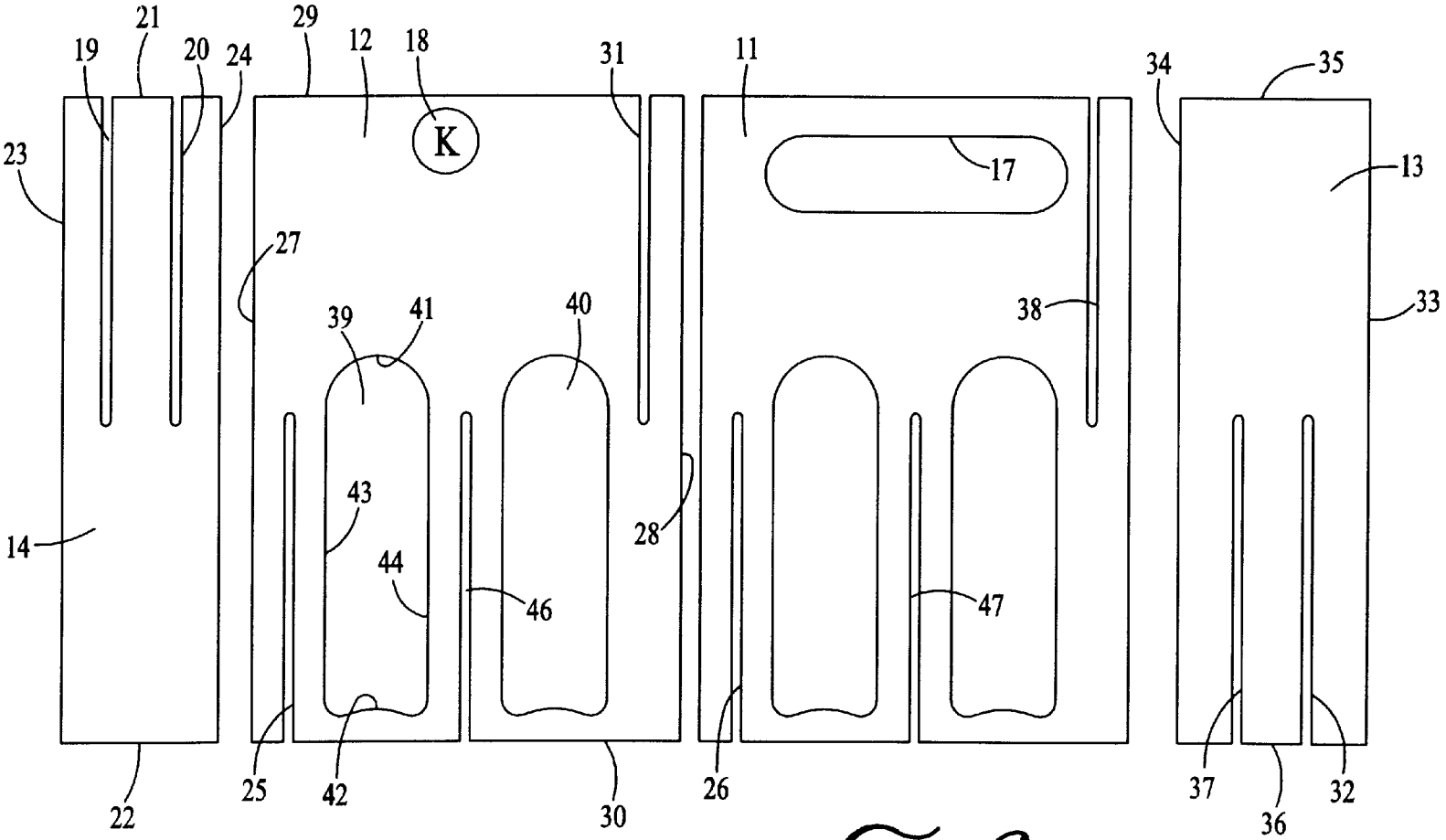
FIG. 2 is a plan view of the four panels of the carrying case of FIG. 1.
Figure 5:
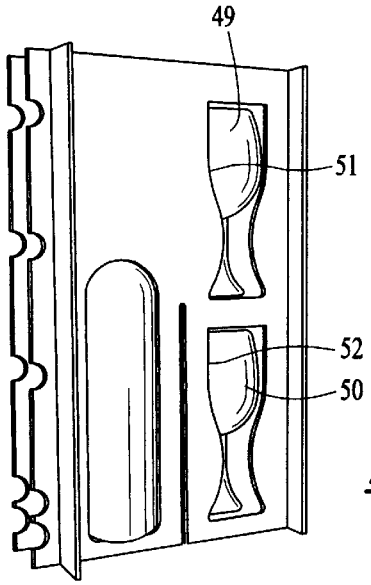
FIG. 5 is a perspective view of an alternate configuration of the carrying case of FIG. 1.

A wine case of the present invention is shown in perspective view in FIG. 1 and indicated generally by reference character 10. Wine case 10 has a front panel 11. The location of back panel 12 is indicated in FIG. 1 and is shown in FIG. 2. Wine case 10 has a right side panel 13 and a left side panel 14.

Two wine bottles 15 and 16 are shown held by wine case 10. A handle 17 is formed in front panel 11 and a logo 18 may be displayed through the handle 17.

Turning now to FIG. 2, it can be seen that left side panel 14 has a pair of slots 19 and 20 extending downwardly from top edge 21 about half way to bottom edge 22. These slots are extended inwardly from left side edge 23 and right side edge 24.

Slot 20, which is the right slot, fits into left side slot 25 of back panel 12. Similarly, left side slot 19 fits into left side slot 26 of front wall panel 11.

Back panel 12 has a left side edge 27, and right side edge 28, a top edge 29, and a bottom edge 30. Right side slot 31 mates with right side slot 32 of right side panel 13. Right side panel 13 has a right side 33, a left side 34, a top 35 and a bottom 36. It also has a left side slot 37, which fits into a right side slot 38 of front wall panel 11.

Back panel 12 has two wine bottle openings 39 and 40. Each have an opening upper wall 41, and an opening bottom wall 42, which comprises a bottle supporting floor. Opening 39 has two generally vertical side edges 43 and 44. The side edges 43 and 44 are, of course, spaced closer together than an outside diameter of the wine bottle to be supported.

The shape of the openings 39 and 40 are, of course, dependent upon the consumer product being held and displayed. For instance, if the bottle were generally hour glass shaped, then the side walls would not be vertical, but would have a slight curve to match the shape of the product being held. It is preferable in the case of wine bottles, that bottle supporting wall 42 have a slightly convex curve as shown in FIG. 2. Since the bottom of better wine bottles are often indented, this curve helps urge the front and back wall panels towards one another slightly and generally stabilizes the assembly.

As shown in FIG. 3, the panels of wine case 10 can be reassembly into a wine rack 45. This requires the addition of a central slot 46 in back panel 12 and slot 47 in front panel 11. Wine rack 45 can hold three wine bottles, although only wine bottles 15 and 16 are shown in FIG. 3.

FIG. 4 shows how a second wine case 10 can be utilized to provide a wine rack 48 that can hold five bottles of wine. This is accomplished by an additional front panel 11' and back panel 12'.

Figure 6:
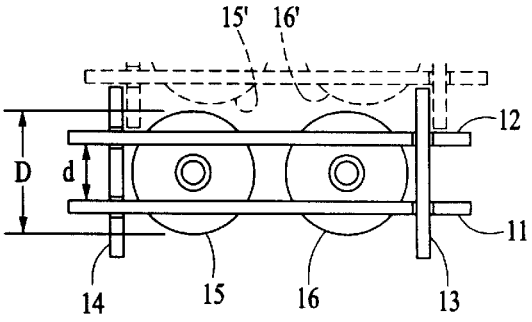
FIG. 6 is a top view of the case of FIG. 1.

While the carrying case of the present invention has been discussed with regard to holding wine bottles, it can also be configured to hold other consumer products, such as two wine glasses 49 and 50, shown held in openings 51 and 52. The mechanism of holding products is shown in top view in FIG. 6, where it can be seen that wine bottles 15 and 16 have an outside diameter D larger than the space d between panels 11 and 12. It can also be seen that the extension of side edges 13 and 14 are such that they prevent the wine bottles 15 and 16 from touching the bottles 15' and 16' shown in phantom view in FIG. 6.

Figure 7:
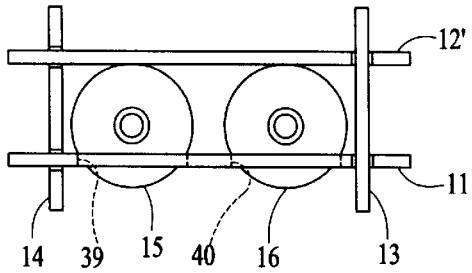
FIG. 7 is a top view of an alternate embodiment of the case of FIG. 1.

As long as the material of construction of the panels is structurally strong, such as plywood, bottles 15 and 16 can be supported by wine bottle openings 39 and 40 in panel. Panel 12' has no such openings as shown in FIG. 7.

The carrying case of the present invention can, of course, be configured to hold a single bottle of wine or other consumer products, or a multitude of them. It may be fabricated from plywood, such as ¼" plywood. Alternatively, it could be fabricated from corrugated board, plastic sheeting, foam core board, or any other product, having the requisite strength, depending upon the product for which it is designed to hold. While the panels are shown as being flat in the drawings, they may be slightly curved. Also, a central panel could be added for further strength, as viewed, for instance, in FIG. 6. Such panel would be placed between the two bottles of wine 15 and 16, if additional strength is desired.

The result is an exceptionally attractive display case for consumer products, which is also capable of shipping the products when confined in a larger case. The ability of the light to show through the product is often a major sales plus.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A carrying case for carrying and displaying at least one consumer product, said at least one consumer product having a bottom, a side wall, and an upper portion, said carrying case comprising:

a front wall panel and a back wall panel, said front wall panel having at least one consumer product opening, each of said front and back wall panels having a top edge, a right side edge, a left side edge, a bottom edge, an outer surface and an inner surface, and a wall thickness, said consumer product opening having an opening bottom wall, two generally vertical opening side edges and an opening upper wall, and each panel having a right side slot extending vertically from one of said top and bottom edges to an inner area of said panel near the right side edge of each panel and a left side slot extending vertically from the other one of said top and bottom edges to an inner area of said panel near the left side edge of each panel;

a right and a left side panel each having a top edge, a right side edge, a left side edge, a bottom edge, an outer surface and an inner surface, and a wall thickness and the right side panel having a pair of slots extending from one of said top and bottom edges and the left side panel having a pair of slots extending from the other one of the top and bottom edges, whereby the carrying case is assembled by placing a consumer product against said consumer product opening in said front panel so that the bottom of said consumer product rests against the opening bottom wall, placing the back panel against the consumer product on the opposite side of said consumer product so that the back panel presses the consumer product against the two generally vertical side edges of said product opening in said front panel, inserting said pair of slots of said left side panel into the left side slot of said back panel and the left side slot of said front panel and moving the left side panel so that the top edge thereof is aligned with the top edge of the front and back panels and inserting said pair of slots of said right side panel into the right side slot of said back panel and the right side slot of said front panel and moving the right side panel so that the top edge thereof is aligned with the top edge of the front and back panels thereby capturing said consumer product between the front and back panels.

2. A carrying case for carrying and displaying at least one bottle of wine, said at least one bottle of wine having a bottom, a side wall, a narrowed neck and an upper pouring spout, said carrying case comprising:

a flat front wall panel and a flat back wall panel each having at least one wine bottle opening, each of said flat front and back wall panels having a top edge, a right side edge, a left side edge, a bottom edge, an outer surface and an inner surface, and a wall thickness, each said wine bottle opening having an opening bottom wall, two generally vertical opening side edges and an opening upper wall, and each panel having a right side slot extending vertically from one of said top and bottom edges to an inner area of said panel near the right side edge of each panel and a left side slot extending vertically from the other one of said top and bottom edges to an inner area of said panel near the left side edge of each panel;

a flat right side panel and a flat left side panel each having a top edge, a right side edge, a left side edge, a bottom edge, an outer surface and an inner surface, and a wall thickness and the right aide panel having a pair of slots extending from one of said top and bottom edges and the left side panel having a pair of slots extending from the other one of the top and bottom edges, whereby the carrying case is assembled by placing a wine bottle against said wine bottle opening in said back panel so that the bottom of said wine bottle rests against the opening bottom wall, placing the front panel against the wine bottle on the opposite side of said wine bottle so that the wine bottle opening bottom wall of said front panel rests against the bottom of the wine bottle, inserting said pair of slots of said flat left side panel into the left side slot of said back panel and the left side slot of said front panel and moving the left side panel so that the top edge thereof is aligned with the top edge of the front and back panels and inserting said pair of slots of said flat right side panel into the right side slot of said back panel and the right side slot of said front panel and moving the right side panel so that the top edge thereof is aligned with the top edge of the front and back panels thereby capturing said wine bottle between the openings in the front and back panels.

3. The carrying case of claim 2 wherein said front and back wall panels each have two wine bottle openings.

4. The carrying case of claim 3 further including a central slot formed vertically in said flat front and back wall panels extending from one of said top and bottom edges to about a midpoint of said flat front and back wall panels at about a vertical, longitudinal central axis, said central slots each having a slot width about equal to the wall thickness of said flat front and back wall panels whereby said flat front and back wall panels can be joined together by mating said central slots so that the central slot of the flat front wall panel extends over an imaginary line comprising an extension of the central slot of said flat back wall panel and the central slot of the flat back wall panel extends over an imaginary line comprising an extension of the central slot of said flat front wall panel and one of the pair of slots of each right and left side panel is inserted into one of said right and left side slots of both of said flat front and back wall panels to form a wine rack capable of holding three bottles of wine in a horizontal orientation.

5. The carrying case of claim 2 further including a handle opening formed in at least one of said flat front and flat back wall panels, said handle opening formed near the top of said at least one of said flat front and flat back wall panels.

6. The carrying case of claim 2 wherein each of said panels if fabricated from one quarter inch thick plywood.

7. The carrying case of claim 2 wherein said opening bottom wall of said wine bottle opening in said flat front and back wall panel forms a convex curve.

8. The carrying case of claim 7 wherein said opening upper wall of said wine bottle openings forms a concave curve.

9. The carrying case of claim 2 wherein said flat front and said flat back wall panels additionally have a wine glass opening, each wine glass opening having a flat bottom wall, two curved side walls and an upper wall whereby the carrying case can hold at least one bottle of wine and at least one wine glass.

10. The carrying case of claim 9 wherein said flat front and said flat back wall panels each have one wine bottle opening and two wine glass openings.

* * * * *